US006053799A

United States Patent [19]

Himstedt

[11] Patent Number: 6,053,799

[45] Date of Patent: Apr. 25, 2000

[54] DOLL JOINT

[76] Inventor: Annette Himstedt, Karl-Schurz-Strasse 27, D-33100 Paderborn, Germany

[21] Appl. No.: 09/117,862

[22] PCT Filed: Jan. 25, 1997

[86] PCT No.: PCT/EP97/00345

§ 371 Date: Mar. 22, 1999

§ 102(e) Date: Mar. 22, 1999

[87] PCT Pub. No.: WO97/28868

PCT Pub. Date: Aug. 14, 1997

[30] Foreign Application Priority Data

Feb. 10, 1996 [DE] Germany ..... 296 02 347 U

[51] Int. Cl.[7] ..... A63H 3/46

[52] U.S. Cl. ..... 446/381; 446/371; 446/320

[58] Field of Search ..... 446/320, 354, 446/371, 378, 379, 381, 383

[56] References Cited

U.S. PATENT DOCUMENTS

| | | | |
|---|---|---|---|
| 553,643 | 1/1896 | Fausel | 446/376 |
| 1,134,716 | 4/1915 | Wulkan et al. | 446/381 |
| 3,319,846 | 5/1967 | Wolf | 446/320 X |
| 3,805,302 | 4/1974 | Mathys | 446/376 X |

FOREIGN PATENT DOCUMENTS

| | | | |
|---|---|---|---|
| 1219410 | 5/1960 | France | 446/383 |
| 2805369 | 8/1979 | Germany | 446/376 |
| 121691 | 1/1919 | United Kingdom | 446/378 |
| 323622 | 1/1930 | United Kingdom | 446/376 |
| 2191956 | 12/1987 | United Kingdom | 446/376 |

*Primary Examiner*—D. Neal Muir
*Attorney, Agent, or Firm*—Bachman & LaPointe, P.C.

[57] ABSTRACT

The invention relates to a joint for fastening movable members to a doll's torus, in particular dolls' arms to an upper section. A rotating insert is put into the movable member, in particular the doll's arm, and both rotating sections are connected to each other to form a joint.

12 Claims, 1 Drawing Sheet

DOLL JOINT

BACKGROUND OF THE INVENTION

The invention relates to a joint for fastening movable elements to a doll's body, in particular doll's arms to an upper part.

Dolls of many shapes and design are known. The present case is concerned primarily with extremely high quality dolls which are extremely valuable not only because of the design but also because of the material used. These dolls are intended to be as lifelike as possible, some of them being of a size which corresponds to the actual life size. Each type of doll is only manufactured in a small number and is generally made of a special, body-approximating plastic, such as a vinyl. It is compression-molded in special molds.

To connect the individual, movable elements, such as the head, arms and legs, coupling parts are known (EP-A-0 087 567) but these merely permit rotation of the movable elements. This does not give a lifelike portrayal.

DE-A 40 37 962 discloses a further connecting piece which comprises a textile material which is filled with filler. Although by this means each limb of a doll can be brought into a lifelike position, this position cannot be maintained without assistance.

The object of the present invention is to be able to bring the movable elements of the doll permanently into a desired position which is as lifelike as possible.

SUMMARY OF THE INVENTION

This object is achieved by inserting a rotary part into the doll's body, in particular the upper part, and a rotary insert into the movable element, in particular the doll's arm, and connecting both rotary parts to one another in the manner of a joint.

This joint according to the invention permits a greatly expanded possibility for positioning the movable elements of dolls. Any lifelike position can be achieved.

The joint-like connection of the two rotary parts preferably comprises a forked joint, two lugs being provided on one rotary part, which lugs form a slot in which a tongue of the insert engages. The lugs and tongues are connected to one another via a pin or a sleeve, this sleeve being inserted into corresponding holes in the lugs and tongue. The sleeve ends are then widened at both ends so that the lugs and the tongues are clamped together. This results in friction between the tongue and lugs, with the result that this friction has to be overcome to adjust the arms. This ensures that arms remain in a desired position.

The lugs are adjoined by a disk, then a ring, then a rotary cone which is then adjoined by an inner disk. All of the elements have a synchronized diameter, the diameter of the disk being the largest. The diameter of the ring then follows and then the diameter of the inner disk. The rotary cone has the smallest diameter since it sits in an insert hole in the doll's body in the position of use. In this case, the insert hole is designed such that it likewise surrounds; the rotary cone again in a frictionally locking manner, with the result that to rotate the cone this friction has to be overcome with force. The frictional locking thereby likewise contributes to the permanent positioning of the movable elements.

In the same manner, the tongue is adjoined by a disk, the latter by a cone and the latter by an inner disk. The disk has a larger diameter than the inner disk since it bears from the outside against the movable element. The cone sits in an insert hole in the movable element and is likewise held there in a frictionally locking manner as described above.

The rotary part and rotary insert are preferably in each case produced integrally from plastic. For insertion into the doll's body or into the movable element, at least that region around the particular insert hole is heated, thereby making the plastic soft.

The joint according to the invention is primarily provided to connect the doll's arms to an upper part. However, it can also be used equally well to connect legs or leg parts to the doll's body and even, but this would only happen in relatively rare cases, for a head so that in this case it would not only be possible for the head to rotate but also to nod.

In a preferred exemplary embodiment the joint is covered in the position of use by a textile covering. As described in DE-A 40 37 962, this is intended to be fastened by ribbons engaging into corresponding annular grooves of the movable element or of the doll's body.

BRIEF DESCRIPTION OF THE DRAWINGS

Further advantages, features and details of the invention emerge from the following description of preferred exemplary embodiments and by reference to the drawing; the latter shows in FIG. 1 a plan view of part of a doll's body.

DETAILED DESCRIPTION

Figure 1:
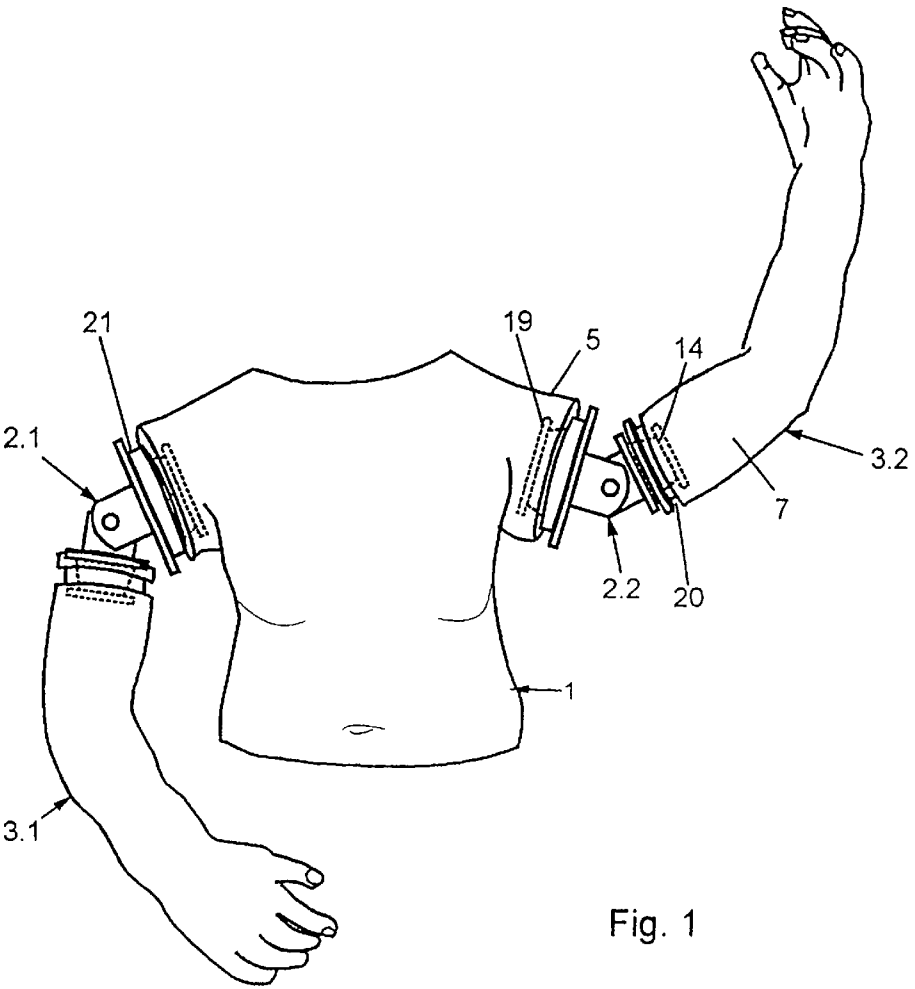
FIG. 1 shows an upper part 1 of a doll's body, to which part an arm 3.1 and 3.2 is fastened via a respective joint 2.1 and 2.2.
Figure 2:
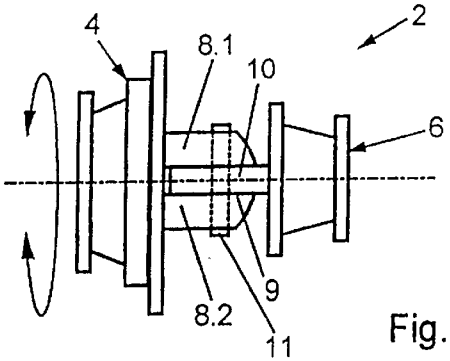
FIG. 2 a plan view of a joint according to the invention.
Figure 3:
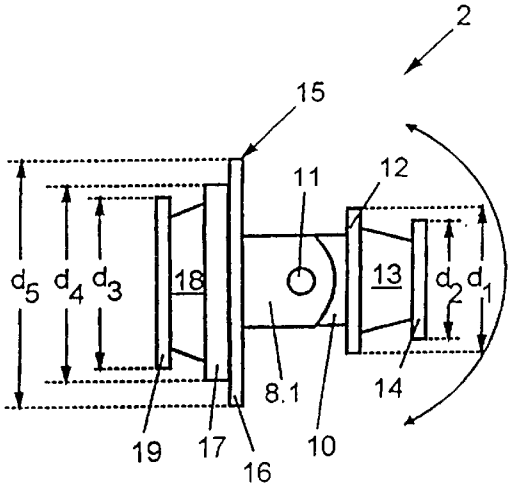
FIG. 3 a plan view of the joint according to FIG. 2 rotated through 90°.

The joint 2 according to FIGS. 2 and 3 comprises two parts. A rotary part 4 serves for the insertion into an upper-arm stump 5 of the upper part 1, while a rotary insert 6 is inserted into an upper arm 7. The rotary part 4 and rotary insert 6 are connected to one another in the manner of a forked joint. In the present exemplary embodiment two lugs 8.1 and 8.2 form a slot 9 into which a tongue 10 of the rotary insert 6 engages. The lugs 8.1 and 8.2 as well as the tongue 10 are connected to one another via a pin 11 which forms a pivot. The pin 11 is preferably further widened at both ends so that it is held in the corresponding holes in the lugs 8.1 and 8.2 and also in the tongue 10. Furthermore, the widenings on both sides cause the elements of the forked joint to be clamped against one another in such a manner that the tongue 10 is held in the slot 9 in a manner such that it is difficult to rotate. This ensures that an arm 3.1 and 3.2 cannot readily fall out of a desired position.

Instead of the pin 11 it is also possible for a sleeve to be provided, the ends of which sleeve are each widened after the insertion.

The tongue 10 is adjoined by a disk 12 which is connected to an inner disk 14 via a cone 13. The disk 12 has a diameter $d_1$ which is somewhat larger than the diameter $d_2$ of the inner disk.

The lugs 8.1 and 8.2 are also adjoined by a support 15 which comprises a disk 16 and a ring 17. The ring 17 is followed by a rotary cone 18 and this is followed in turn by an inner disk 19. A diameter $d_5$ of the disk 16 is larger than a diameter $d_4$ of the ring 17. The latter is in turn larger than a diameter $d_3$ of the inner disk 19.

The way in which the present invention functions is as follows:

The rotary part 4 and rotary insert 6 are preferably produced integrally from plastic and are connected to one another in the manner of a forked joint via the pin 11 or the above-mentioned metal sleeve. To insert the rotary part 4 and rotary insert 6 into the respective upper-arm stump 5 or the upper arm 7, the upper-arm stump 5 or upper arm 7 are made soft, primarily in the region of an insert hole (not shown in more detail). As a result, the particular inner disk 14 or 19 can be inserted more easily into the insert hole, with the result that the particular cone 13 or rotary cone 18 then sits in this insert hole. A diameter of the insert hole is selected in this case such that an edge of the insert hole fits tightly against the cone 13 or rotary cone 18 so that the particular rotary part 4 or rotary insert 6 sits in the insert hole in a manner such that it is difficult to rotate. This also prevents unintentional movement of the arms 3.1 and 3.2.

While an annular groove 20 is molded into the upper arm 7, the upper-arm stump 5, the ring 17 and the disk 16 form a further annular groove 21, it being possible for a band, as a component of a textile covering (not shown in more detail) which covers the joint 2, to be fastened in the annular grooves 20 and 21. A covering of this type is described in DE-A 40 37 962, reference being expressly made here to this document. Instead of, or in addition to, the filler described there, in the present case the joint 2 is provided.

What is claimed is:

1. A joint for fastening movable elements to a doll's body, in particular doll's arms (3.1, 3.2) to an upper part (1), wherein a rotary part (4) is inserted into the doll's body, in particular the upper part (1), and a rotary insert (6) is inserted into the movable element, in particular the doll's arm (3.1, 3.2), and both rotary parts (4, 6) are connected to one another in the manner of a joint, the rotary part (4) has two lugs (8.1, 8.2) wherein the lugs (8.1, 8.2) are adjoined by a disk (16), then a ring (17), then a rotary cone (18) and the rotary cone (18) by an inner disk (19).

2. The joint as claimed in claim 1, wherein the joint-like connection of the two rotary parts (4, 6) is a forked joint.

3. The joint as claimed in claim 2, wherein the rotary part (4) has two lugs (8.1, 8.2) which form a slot (9) into which a tongue (10) engages.

4. The joint as claimed in claim 3, wherein the lugs (8.1, 8.2) and tongue (10) have passing through them a pin (11) or a sleeve, which pin or sleeve forms a pivot.

5. The joint as claimed in claim 4, wherein the pin (11) or the sleeve is widened at both ends.

6. The joint as claimed in claim 1, wherein a diameter ($d_5$) of the disk (16) is larger than a diameter ($d_4$) of the ring (17) and the latter is larger than a diameter ($d_3$) of the inner disk (19).

7. The joint as claimed in claim 1, wherein the disk (16), ring (17) and part of the doll's body together form an annular groove (21).

8. The joint as claimed in claim 2 wherein the tongue (10) is adjoined by a disk (12), the disk (12) is adjoined by a cone (13) and the cone (13) by an inner disk (14).

9. The joint as claimed in claim 8, wherein a diameter ($d_1$) of the disk (12) is larger than a diameter ($d_2$) of the inner disk (14).

10. The joint as claimed in claim 1 wherein the rotary part (4) and rotary insert (6) are in each case integrally produced from plastic.

11. The joint as claimed in claim 8 wherein the cone (13) and rotary cone (18) are seated in an insert hole in the doll's body or in the movable element in a frictionally locking and rotationally difficult manner.

12. A joint for fastening movable elements to a doll's body, in particular doll's arms (3.1, 3.2) to an upper part (1), wherein a rotary part (4) is inserted into the doll's body, in particular the upper part (1), and a rotary insert (6) is inserted into the movable element, in particular the doll's arm (3.1, 3.2), and both rotary parts (4, 6) are connected to one another in the manner of a joint, wherein the rotary part (4) has two lugs (8.1, 8.2) which form a slot (9) into which a tongue (10) engages, wherein the tongue (10) is adjoined by a disk (12), the disk (12) is adjoined by a cone (13) and the cone (13) by an inner disk (14) and wherein the cone (13) and a rotary cone (18) are seated in the movable element in the doll's body, respectively in a frictionally locking and rotationally and difficult manner.

* * * * *